US005480767A

United States Patent [19]

Tosaka et al.

[11] Patent Number: 5,480,767

[45] Date of Patent: Jan. 2, 1996

[54] SILVER HALIDE COLOR PHOTOGRAPHIC LIGHT-SENSITIVE MATERIAL AND IMAGE-FORMING PROCESS

[75] Inventors: Yasuo Tosaka; Yoshiyuki Nonaka; Keiichi Hoshino, all of Odawara, Japan

[73] Assignee: Konica Corporation, Japan

[21] Appl. No.: 340,029

[22] Filed: Nov. 14, 1994

[30] Foreign Application Priority Data

Nov. 17, 1993 [JP] Japan ..... 5-288383

[51] Int. Cl.[6] ..... G03C 7/00

[52] U.S. Cl. ..... 430/358; 430/510; 430/538; 430/531; 430/536; 430/539; 430/642; 430/517

[58] Field of Search ..... 430/510, 358, 430/538, 531, 536, 539, 642, 517

[56] References Cited

U.S. PATENT DOCUMENTS

| | | | |
|---|---|---|---|
| 2,622,026 | 12/1952 | Hunter et al. | 430/519 |
| 4,558,002 | 12/1985 | Aotsuka et al. | 430/538 |
| 4,755,454 | 7/1988 | Aotsuka et al. | 430/538 |
| 5,075,196 | 12/1991 | Daems et al. | 430/538 |
| 5,151,345 | 9/1992 | Hasebe | 430/525 |
| 5,362,626 | 11/1994 | Kojima et al. | 430/642 |
| 5,364,748 | 11/1994 | Yoneyama | 430/505 |
| 5,382,506 | 1/1995 | Tosaka et al. | 430/358 |

FOREIGN PATENT DOCUMENTS

| | | |
|---|---|---|
| 481651 | 4/1992 | European Pat. Off. . |
| 554027 | 8/1993 | European Pat. Off. . |

*Primary Examiner*—Thomas R. Neville

*Attorney, Agent, or Firm*—Jordan B. Bierman; Bierman and Muserlian

[57] ABSTRACT

Disclosed is a silver halide color photographic light-sensitive material comprising a reflective support comprising polyolefin resin coated paper and provided on one side thereof with photographic component layers comprising a hydrophilic colloidal layer containing a white pigment, a non-sensitive hydrophilic colloidal layer, and a silver halide emulsion layer, wherein at least one of said photographic component layers contains an oil-soluble dye or a colored pigment, either of which is not substantially incapable of being decolorized on a photographic-processing.

9 Claims, No Drawings

SILVER HALIDE COLOR PHOTOGRAPHIC LIGHT-SENSITIVE MATERIAL AND IMAGE-FORMING PROCESS

FIELD OF THE INVENTION

This invention relates to an improvement of a color photographic light-sensitive material and, particularly, to an improvement of an image reproducibility of the highlight portions of the light-sensitive material. Inter alia, this invention also relates to a silver halide color photographic light-sensitive material suitable for preparing a color image for making a proof from a plurality of black-and-white halftone-dot images obtained by making a color-separation and a halftone-dot image conversion in a color plate-making and printing process and, further; this invention relates to an image-forming (or color proof-forming) process in which the above-mentioned silver halide color photographic light-sensitive material.

BACKGROUND OF THE INVENTION

A color image is usually obtained in the following manner. A color light-sensitive material is applied with a color reproduction in a subtractive color system having generally been used. After exposing imagewise the light-sensitive material to light, the exposed silver halide grains thereof are developed with a color developer. The oxidant produced of a color developing agent is reacted with each of yellow, magenta and cyan dye couplers. Next, a color image can be obtained by bleach-fixing and then by washing or stabilizing the light-sensitive material.

Such a color image obtained as mentioned above has been required to be improved in image quality and, particularly, in the color tone of a highlight portion and in image background.

Besides the above, a technique for making use of an anti-irradiation dye and a technique for making use of a black colloidal silver have been disclosed as a technique for improving an image-sharpness. However, these techniques have had such a problem that a sensitivity is seriously lowered, and that a stain may remain in a white background after completing a process. For the purpose of preventing an image-sharpness deterioration from a reflective support, Japanese Patent Publication Open to Public inspection (hereinafter referred to as JP OPI Publication) Nos. 54-46035/1979, 2-28640/1990 and 3-89340/1991, and JP Examined publication Nos. 59-820/1984 and 2-29203/1990, for example, disclose the light-sensitive materials in which the filling factor of a white pigment is increased in a resin-coated layer of the base paper of the above-mentioned reflective support, or a hydrophilic colloidal layer containing a white pigment is provided thereto. However, these light-sensitive materials have been proved to still have such a problem that the contrast in a toe portion and/or the color tone in a highlight portion are varied when a replenishing amount is in short or a processing condition is varied, for example, when a developer is fatigued.

On the other hand, as a method for obtaining a color proof from a plurality of black-and-white halftone-dot images obtained by color-separating a color image and then by converting the color-separated images into halftone-dot images in a color plate-making and printing process, there have so far been the known methods such as an over-lay method in which a color image is formed by making use of a photopolymer and a diazo compounds and a surprint method.

The over-lay method has such an advantage that the operability thereof is very simple and the color proof-making cost is inexpensive and that the resulting color proof can be used only by superposing four colored film sheets (in three subtractive elementary color mixture and in black) one upon another. However, this method has such a disadvantage that a gloss is produced by superposing the film sheets and, therefore, that the texture becomes different from that of the resulting printed matter.

The surprint method is to superpose certain colored images on a support. As for this type of methods, the method has been known from U.S. Pat. Nos. 3,582,327, 3,607,264 and 3,620,726, in which a colored image can be obtained by utilizing the adherence of a photopolymer material and then by making a toner-development.

A method for preparing a color proof has been known from JP Examined Publication No. 47-27441/1972 and JP OPI Publication No. 56-501217/1981, in which an image is transferred to a support by making use of a light-sensitive colored sheet and an image is formed by making an exposure and then a development and, thereafter, another colored sheet is laminated thereon and the same process is then repeated.

A method for making a color-proof has been known from JP OPI Publication No. 59-97140/1984, in which each light-sensitive colored sheet is used and each color-separated film corresponding to the colored-sheets is exposed and then developed and, thereafter, each of the resulting colored images is transferred to the top of a support so that each of the color-proofs can be formed. Each color tone of the resulting color-proofs resembles those of a printed matter, because the toners and colorants of the colored sheets for forming the above-mentioned images have such an advantage that the same colorant as a printing ink can be used.

However, the above-mentioned methods have such a disadvantage not only that plural images have to be superposed and transferred, but also that the operations will take a long time and the production will cost too much.

As for a method capable of solving the above-mentioned disadvantages, JP OPI Publication Nos. 56-113139/1981, 56-104335/1981, 62-280746/1987, 62-280747/1987, 62-280748/1987, 62-280749/1987, 62-280750/1987 and 62-280849/1987 disclose each a method for preparing a color-proof by making use of a silver-salt color photographic light-sensitive material having a white support.

In the above-mentioned method, the following color image is used as an image for making a proof. A color image formed in such a manner that a plurality of color-separated black-and-white halftone-dot images, which were formed by converting a chromatic color original into plural color-separated halftone-dot images, the B/W halftone-dot images are printed one after another by way of a contact-printing or the like and are then color-developed; thereby, the color image is formed of dyes produced imagewise of couplers.

However, in the above-mentioned technique, there is such a disadvantage that a halftone-dot reproduction is liable to be varied particularly in an image area having a narrow halftone-dot area. Particularly when the development conditions should be varied, the above-mentioned variation becomes serious and, therefore, the improvements thereof have been demanded so far.

When a light-sensitive material having a hydrophilic colloidal layer containing a white pigment, of which described in the foregoing JP OPI Publication No. 2-29203/1990 and JP Examined Publication No. 59-820/1984, such light-sensitive material is simply used as a light-sensitive material for a color-proof use, it was proved that a fine-dot reproduction in an area having a narrow halftone-dot area, the color reproduction of a fine image such as that of a hair, and a white background are each deteriorated, when carrying out a running photographic-processing or a preservation of a raw sample.

SUMMARY OF THE INVENTION

It is, accordingly, an object of the invention to provide a silver halide color photographic light-sensitive material in which the reproducibility of the highlight portion and white background of the silver halide color photographic light-sensitive material can be improved and from which a stable color image can be obtained even in a running photographic-processing in which an exposure quantity is varied.

Another object of the invention is to provide a light-sensitive material for color proofing use, that is capable of obtaining an image having a stable tone, in which a fine-dot reproducibility deteriorated in a development condition, a running photographic-processing or a raw sample preservation can be improved when a color proof is prepared of a halftone-dot image information obtained by a color separation and a conversion into a halftone-dot image, by making use of a silver halide color photographic light-sensitive material; and to provide a color-proof preparation method in which the above-mentioned light-sensitive material for color-proofing use is used.

The above-mentioned objects of the invention can be achieved in the following constitution.

(1) A silver halide color photographic light-sensitive material comprising a reflective support composed of polyolefin resin coated paper and provided on one side thereof with photographic component layers comprising a hydrophilic colloidal layer containing a white pigment, a non-sensitive hydrophilic colloidal layer, and a silver halide emulsion layer, wherein at least one of said photographic component layers contains an oil-soluble dye or a colored pigment, either of which is not substantially decolorized upon a photographic-processing.

(2) The silver halide color photographic light-sensitive material as mentioned in (1), wherein an iron content of a gelatin contained in said photographic component layers, is less than 5 ppm.

(3) The silver halide color photographic light-sensitive material as mentioned in (1) or (2), wherein a coating amount of a gelatin contained in said photographic component layers is not more than 9 g/m$^2$.

(4) An image-forming process in which a color proof is prepared by exposing a silver halide color photographic light-sensitive material to light in accordance with a halftone-dot image information comprising a yellow image information, a magenta image information, a cyan image information and a black image information each color-separated from a color image information; wherein the silver halide color photographic light-sensitive material is as mentioned in (1), (2) or (3).

DETAILED DESCRIPTION OF THE INVENTION

The white pigments applicable to the invention include, for example, a futile titanium dioxide, an anatase titanium dioxide, barium sulfate, barium stearate, silica, alumina, zirconium oxide and kaolin. Among them, titanium dioxide is preferred from various reasons. A white pigment is dispersed in, for example, a water-soluble binder made of a hydrophilic colloid such as gelatin into which a processing solution may be permeated. Such a white pigment as mentioned above may be coated in an amount within the range of, preferably, 1 to 50 g/m$^2$ and, more preferably, 2 to 20 g/m$^2$.

A hydrophilic colloidal layer containing a white pigment relating to the invention is preferable to be interposed between a support and a silver halide emulsion layer closest to the support. Between the support and the silver halide emulsion layer closest to the support, it is allowed to arrange a sublayer, if required, to the top of the support, or to arrange a non-sensitive hydrophilic colloidal layer such as an intermediate layer to any position therebetween.

As for a reflective support applicable to the invention, it is preferable to use a support comprised of a base paper serving as the base member thereof and laminated with a polyolefin resin on the both sides of the base paper. The polyolefin resin is also allowed to contain a white pigment such as titanium oxide.

The reflective supports applicable to the invention also include, for example, a synthetic resin-film support such as those of a polypropylene coated with a polyolefin resin on the surface thereof.

There is no special limitation the thicknesses of a reflective support relating to the invention. However, those having a thickness within the range of 80 to 160 μm are preferably used.

In the invention, a photographic component layer include a hydrophilic colloidal layer on the side where an image-forming layer is coated, seeing from a reflective support. Concretely, it includes a hydrophilic colloidal layer containing a white pigment a non-sensitive hydrophilic colloidal layer and a silver halide emulsion layer.

In the invention, an oil-soluble dye and/or a colored pigment, which are not decolorized substantially in a photographic-processing, are contained in at least one of photographic component layers. A photographic component layer containing such a dye and/or pigment as mentioned above is preferable to be a photographic component layer made present on the farther side of a hydrophilic colloidal layer containing a white pigment or on the side farther from a support than from the hydrophilic colloidal layer containing a white pigment.

In the present invention, an oil-soluble dye and/or a colored pigment, which are not decolorized substantially in a photographic-processing, herein means that an absorption spectrum in a post-photographic-processing remains at least 70% to an absorption spectrum produced by an oil-soluble dye and/or a colored pigment in a pre-photographic-processing.

An oil-soluble dye preferably applicable to the invention includes, for example, an organic dye having a solubility to water (that is, a weight ratio of a substance soluble to 100 g of water) of not more than $1\times10^{-2}$ at 20° C., and the typical compounds thereof include, for example, an anthraquinone compound and an azo compound.

An oil-soluble dye relating to the invention is to have a molecular extinction coefficient of, preferably, not less than 5000 and, more preferably, not less than 20000, in the maximum absorption wavelength of not shorter than 400 nm (provided when chloroform is used as a solvent).

An oil-soluble dye preferably applicable to a light-sensitive material of the invention is used in an amount within the range of, preferably, 0.01 to 10 mg/m$^2$ and, more preferably, 0.05 to 5 mg/m$^2$.

An oil-soluble dye applicable to the invention may be applied to any photographic component layer. It is preferable to add it to a non-sensitive hydrophilic colloidal layer other than a coupler-containing layer.

A particularly preferable method for making use of an oil-soluble dye relating to the invention is to contain an oil-soluble dye having a molecular extinction coefficient of not less than 20000 in the maximum absorption wavelength of not shorter than 400nm, in an amount thereof coated within the range of 0.05 to 5 mg/m$^2$, in a non-sensitive hydrophilic colloidal layer other than a coupler-containing layer.

An oil-soluble dye relating to the invention is particularly preferable to be contained in a hydrophilic colloidal layer on the farther side from a support than from a hydrophilic colloidal layer containing a white pigment.

In the invention, a preferable oil-soluble dye is a compound represented by the following formula (1) or (2).

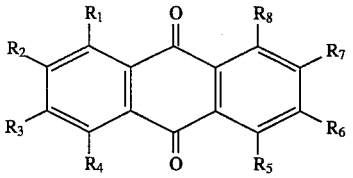

Formula (1)

wherein $R^1$ through $R^8$ each represent a hydrogen atom, a hydroxyl group, a substituted or unsubstituted amino group or a halogen atom.

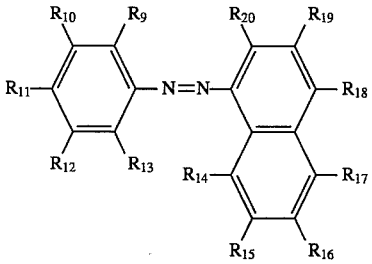

Formula (2)

wherein $R^9$ through $R^{20}$ each represent a hydrogen atom, a halogen atom, a nitro group, a hydroxyl group, an alkyl group, an alkoxyl group, an aminocarbonyl group, a substituted or unsubstituted amino group or an —N=N—R group (in which R represents an aryl group).

The halogen atoms represented by $R^1$ through $R^8$ each denoted in formula (1) include, for example, a chlorine atom and a bromine atom. The amino group represented by $R^1$ through $R^8$ may have a substituent including, for example, an alkyl group (such as a methyl group and a butyl group), an aryl group (such as a phenyl group) and an acyl group (such as a methoxy group and a benzoyl group).

The halogen atoms represented by $R^9$ through $R^{20}$ denoted in formula (2) include, for example, a chlorine atom and a bromine atom. The alkyl groups include, for example, a methyl group, an ethyl group and a propyl group. The alkoxyl groups include, for example, a methoxy group, an ethoxy group and a propoxy group. The aminocarbonyl groups include, for example, a methylaminocarbonyl group and phenylaminocarbonyl group. The amino groups represented by $R^9$ through $R^{20}$ may also have each a substituent similar to those given in formula (1)

Some typical examples of an oil-soluble dye applicable to the invention will be given below. However, the invention shall not be limited thereto.

Formula (1)

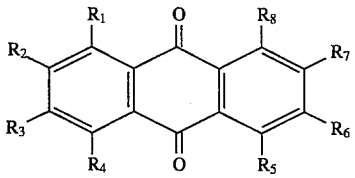

| Compound No. | $R^1$ | $R^2$ | $R^3$ | $R^4$ | $R^5$ | $R^6$ | $R^7$ | $R^8$ |
|---|---|---|---|---|---|---|---|---|
| 1 | H | H | H | H | H | H | H | $-NHCH_3$ |
| 2 | H | H | H | H | $-OH$ | H | H | 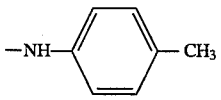 |
| 3 | H | H | H | H | $-NH_2$ | H | H | $-NH_2$ |
| 4 | H | H | H | H | $-NH_2$ | H | $-Br$ | $-OH$ |

-continued
Formula (1)
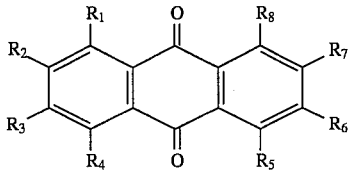
| Compound No. | $R^1$ | $R^2$ | $R^3$ | $R^4$ | $R^5$ | $R^6$ | $R^7$ | $R^8$ |
|---|---|---|---|---|---|---|---|---|
| 5 | H | H | H | H | 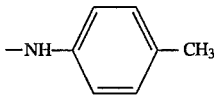 | H | H | $-NHCH_3$ |
| 6 | H | H | H | H | 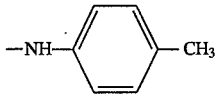 | H | H | $-NH_2$ |
| 7 | H | H | H | H | 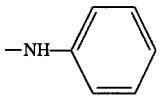 | H | H | 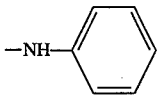 |
| 8 | H | H | H | H | 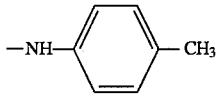 | H | H | 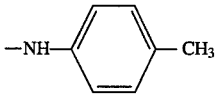 |
| 9 | H | H | H | H | $-NHC_4H_9$ (n) | H | H | $-NHC_4H_9$ (n) |
| 19 | H | H | H | H | H | H | H | 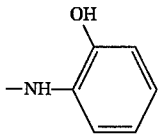 |
| 21 | H | H | H | 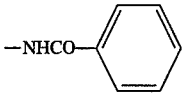 | H | H | H | 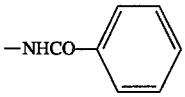 |
Formula (2)
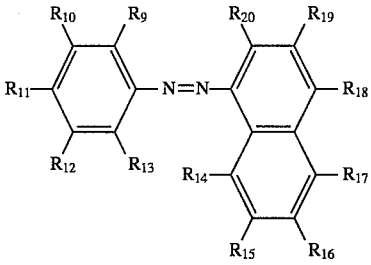
| Compound No. | $R^9$ | $R^{10}$ | $R^{11}$ | $R^{12}$ | $R^{13}$ | $R^{14}$ | $R^{15}$ | $R^{16}$ | $R^{17}$ | $R^{18}$ | $R^{19}$ | $R^{20}$ |
|---|---|---|---|---|---|---|---|---|---|---|---|---|
| 10 | $-CH_3$ | H | H | H | H | H | H | H | H | H | H | $-OH$ |
| 11 | H | H | 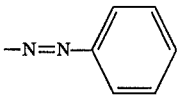 | H | H | H | H | H | H | $-NH_2$ | H | H |
| 12 | $-OCH_3$ | H | H | H | H | H | H | H | H | H | H | $-OH$ |

-continued
Formula (2)
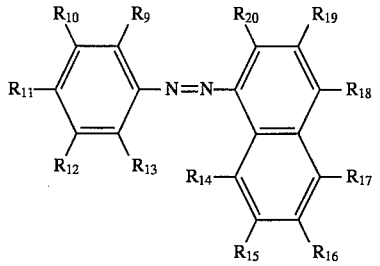
| Compound No. | $R^9$ | $R^{10}$ | $R^{11}$ | $R^{12}$ | $R^{13}$ | $R^{14}$ | $R^{15}$ | $R^{16}$ | $R^{17}$ | $R^{18}$ | $R^{19}$ | $R^{20}$ |
|---|---|---|---|---|---|---|---|---|---|---|---|---|
| 13 | H | H | 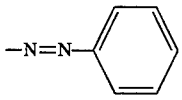 | H | H | H | H | H | H | H | H | —OH |
| 14 | H | H | $-OC_2H_5$ | H | H | H | H | H | H | —OH | H | H |
| 15 | $-CH_3$ | H | 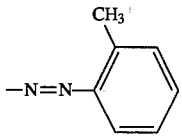 | H | H | H | H | H | H | H | H | —OH |
| 22 | $-NO_2$ | H | $-NO_2$ | H | H | H | H | H | H | H | H | —OH |
| 23 | H | —Cl | $-NO_2$ | H | H | H | H | H | H | H | 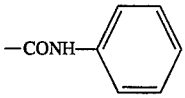 | —OH |
| 25 | $-CH_3$ | H | H | $-NO_2$ | H | H | H | H | H | H | 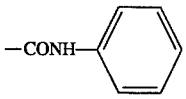 | —OH |
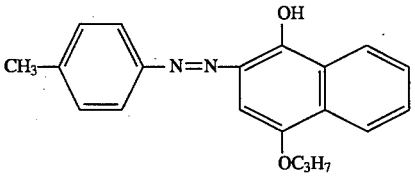
16
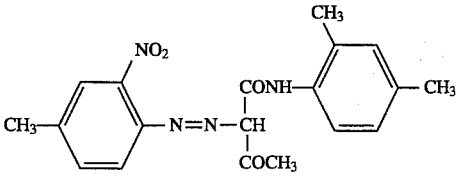
17
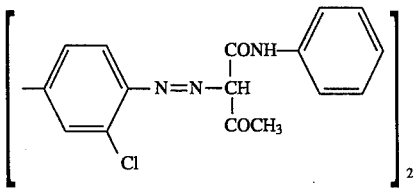
18
-continued
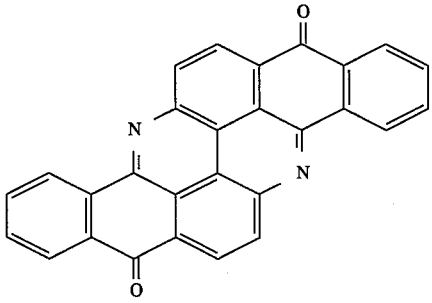
20
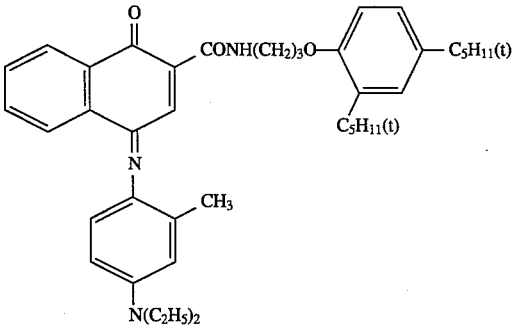
24

-continued

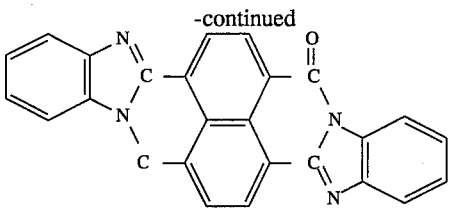

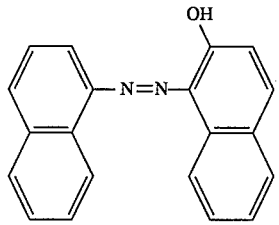

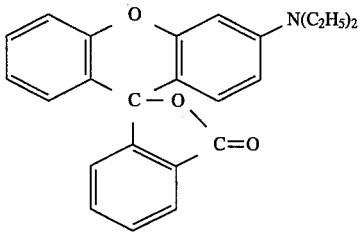

As for the colored pigments relating to the invention, a lake, a pigment and an organic pigments such as a metal-complex salt pigment and, besides, an inorganic pigments may be used as a particularly preferable pigments of the invention. The typical examples thereof preferably applicable to the invention include a cobalt pigment such as cobalt green and cobalt violet, an iron pigment such as red iron oxide and Prussian-blue, a chromium pigment such as chromium oxide and viridian, a manganese pigment such as mineral violet, a cooper pigment such as emerald green, a vanadium pigment such as vanadium blue, a sulfide pigment such as cadmium yellow and ultramarine blue.

The organic pigments of the invention are each applicable to any photographic component layers. It is particularly preferable to contain them in a hydrophilic colloidal layer on the farther side from a support than from a hydrophilic colloidal layer containing a white pigment.

An organic pigment may be used in an amount coated within the range of, preferably, 0.01 to 10 mg/m$^2$ and, more preferably, 0.05 to 5 mg/m$^2$.

Now, gelatin applicable to the invention will be detailed below.

Gelatin contains various heavy metals such as iron, copper, zinc and manganese as impurities. Generally, gelatin contains an iron ion within the range of 5 to 20 ppm.

An iron content of gelatin contained in a light-sensitive material of the invention is less than 5 ppm and, preferably, less than 3 ppm. An iron content of gelatin is a content of iron and iron ions contained in gelatin, and it can be measured in accordance with the method described in PAGI method (atomic absorption spectrometry disclosed on Bulletin of The Joint Council of the Regulation on Photographic Gelatin Tests, the 6th ed., Oct., 1987).

When a light-sensitive material of the invention contains a plurality of gelatin different from each other, an iron content of gelatin can be specified by an average value of the iron contents of the total amount of gelatin contained in the light-sensitive material, that is to say, it can be specified by a ratio of a weight of iron contained in the total amount of gelatin contained in the light-sensitive material to a weight of the total amount of gelatin contained in the light-sensitive material.

As for a method of reducing a metal ion contained in gelatin, an ion-exchange photographic-processing is usually carried out by making use of an ion-exchange resin. However, a very small amount of iron ions contained in gelatin cannot always effectively be removed. Also, there further uses a method of utilizing a chelate resin, a method of extracting a solvent or a method of separating bubbles. A preparation of gelatin by making use of a raw material containing a small amount of iron is effective to reduce an iron content of gelatin and, further, a prevention of iron mixing-in from a gelatin preparation apparatus or a removal of mixed-in iron by making use of a magnet is also effective to reduce an iron content of gelatin.

Particularly, for removing a coloring component of gelatin, it is preferable to use gelatin having a transmittance improved by treating a gelatin extractant solution in a hydrogen peroxide photographic-processing, by extracting the coloring component from a hydrogen peroxide treated raw ossein or by making use of ossein prepared of a colorless raw bone.

Gelatin of the invention may be any one of alkali-treated ossein gelatin, acid-treated gelatin, a gelatin derivative and denatured gelatin. Among them, alkali-treated ossein gelatin is particularly preferred.

A transmittance of gelatin applicable to a photographic light-sensitive material relating to the invention is preferable to be not less than 70% when the subject transmittance is measured upon preparing the gelatin to be a 10% solution and by making use of a spectrophotometer at 420 nm. As for a method of removing a coloring component of gelatin and increasing a transmittance, the above-mentioned method is carried out. It is, however, preferable to use a method in which a hydrogen peroxide photographic-processing is carried out in an ossein preparation stage, a method in which hydrogen peroxide is added in a liming tank for liming ossein so that hydrogen peroxide is reacted with the ossein in the course of carrying out the liming, or a method in which a gelatin extractant solution is used. A hydrogen peroxide solution is available on the market to be used. A concentration, an addition-reaction time and a successive washing method each of hydrogen peroxide may suitably be determined so as to be optimum.

A jelly strength (measured in PAGI method) of gelatin applicable to the invention is preferably not less than 250 g and, more preferably, not less than 270 g.

A calcium content (measured in PAGI method) of gelatin applicable to the invention is, preferably, not more than 1000 ppm and, more preferably, not more than 500 ppm. For reducing a calcium content of gelatin, it is generally preferable to carry out an ion-exchange resin column photographic-processing.

There is no special limitation to a weight-average molecular weight of gelatin of the invention. It is, however, preferable to be within the range of 10000 to 200000 in terms of an weight-average molecular weight.

A total amount of gelatin contained in a light-sensitive material of the invention is preferable to be less than 11.0 g/m$^2$. There is no special limitation to the lower limit thereof. However, from the viewpoint of a physical or photographic property, it is generally preferable to be not less than 3.0 g/m$^2$. A gelatin amount may be obtained in a moisture measurement method described in PAGI method by converting a subject gelatin amount into a weight of gelatin a moisture of 11.0%.

Gelatin contained in a light-sensitive material is hardened by a hardener. There is no special limitation to the hardeners applicable thereto. The hardeners having been known in the photographic industry include, for example, a carboxyl-activation type hardener and a macromolecular hardener, such as those of the aldehyde type, active vinyl type, active halogen type, epoxy type, ethylene imine type, methane sulfonate type, carbodiimide type, isoxazole type and a carbamoyl pyridium salt. The particularly preferable hardeners include, for example, a vinyl sulfone type hardener (including, for example, compounds H-1 through H-24 given in JP OPI Publication No. 2-188753/1990, pp. 13–14) and/or a chlorotriazine type hardener (including, for example, compounds II-1 through II-13 and III-1 through III-10), or a carboxyl-activation type hardener given in JP OPI Publication Nos. 2-82237/1990 and 1-129245/19.89.

A swelling ratio of a light-sensitive material of the invention, (that is, a ratio of a hydrophilic colloidal layer thickness in a processing solution to a hydrophilic colloidal layer thickness in the dry state), is to be within the range of, preferably, 1.5 to 4.0 and, more preferably, 2.0 to 3.0.

As for a silver halide emulsion applicable to the invention, it is also allowed to use a silver halide emulsion capable of forming a negative image upon making a development by making use of a silver halide emulsion of the type of forming a latent image on the surfaces of the silver halide grains thereof, that is capable of forming a latent image on the surface. It is also preferable to use such an emulsion that a fogging photographic-processing (or a nucleation photographic-processing) is carried out after exposing imagewise to light by making use of an internal latent image forming type silver halide emulsion comprising the grains thereof having the grain surfaces remaining unfogged in advance and then a surface development is carried out or a surface development is carried out with carrying out a fogging photographic-processing after exposing imagewise to light, thereby a direct positive image can be obtained.

The above-mentioned fogging photographic-processing may be carried out by making an overall exposure, may also be carried out chemically by making use of a foggant, may further be carried out by making use of a high-energy developer, or may still further be carried out by making a heat photographic-processing. The expression, "an emulsion containing the above-mentioned internal latent image type silver halide emulsion grains" herein means an emulsion containing silver halide grains each having a photosensitive nucleus mainly inside each of the silver halide crystal grains thereof and capable of forming a latent image inside the grains when making an exposure.

In the field of the above-mentioned internal latent image type direct positive techniques, various techniques have so far been known. For example, the techniques include those described in U.S. Pat. Nos. 2,592,250, 2,466,957, 2,497,875, 2,588,982, 3,761,266, 3,761,276 and 3,796,577 and British Patent No. 1,151,363.

The mechanisms of forming a positive image have not always been cleared. However, for example, the following description appears in Photographic Science and Engineering, Vol. 20, p. 156, 1976.

A photoelectron produced inside a silver halide crystal grain by making an imagewise exposure is captured selectively inside the grain, so that an internal latent image may be formed. The internal latent image works as an effective capture center to an electron made present in a conduction band. In a grain exposed to light, therefore, an electron injected in the course of carrying out a successive fogging development is captured inside the grain, so that the latent image may be intensified. In this case, the latent image is not developed in a surface development, because it is inside the grain. In a grain remaining unexposed imagewise to light, on the other hand, at least a part of electrons injected therein are captured on the grain surfaces, so that the latent image is formed thereon. The grains are then developed in a surface development.

The above-mentioned internal latent image type silver halide grains remaining unfogged in advance, that is applicable to the invention, are silver halide grains capable of forming a latent image mainly inside thereof and having most of photosensitive nuclei inside thereof. These grains contain any one of silver halides including, for example, silver bromide, silver chloride, silver chlorobromide, silver chloroiodide, silver iodobromide or silver chloroiodobromide.

A transparent support of a sample was so coated in a coated weight of silver within the range of about 1 to 3.5 g/m$^2$. A part of the resulting sample was exposed to light through a photointensity scale extending over a certain specific time within the range of about 0.1 seconds to about 1 second. When the exposed sample was developed at 20° C. for 4 minutes by making use of the following surface developer A capable of developing only an image formed on the surfaces of grains not substantially containing any silver halide solvent, an emulsion is particularly preferable when it shows a maximum density not higher than one fifth of a maximum density obtained when another part of the same emulsion sample is exposed to light and is the developed at 20° C. for 4 minutes by making use of the following internal developer B capable of developing an image present inside the grains. Another emulsion is further preferable when the resulting maximum density obtained by making use of surface developer A is not higher than one tenth of a maximum density obtained when developing it by making use of internal developer B.

| (Surface developer A) | |
|---|---|
| Metol | 2.5 g |
| L-Ascorbic acid | 10.0 g |
| Sodium metaborate (Tetrahydrate) | 35.0 g |
| Potassium bromide | 1.0 g |
| Add water to make | 1000 ml |
| **(Internal developer)** | |
| Metol | 2.0 g |
| Sodium sulfite (anhydride) | 90.0 g |
| Hydroquinone | 8.0 g |
| Sodium carbonate (monohydrate) | 52.5 g |
| Potassium bromide | 5.0 g |
| Potassium iodide | 0.5 g |
| Add water to make | 1000 ml |

An internal latent image type silver halide emulsion preferably applicable to the invention includes those prepared in various processes. For example, a conversion type silver halide emulsion described in U.S. Pat. No. 2,592,250; a silver halide emulsion having internally chemical-sensitized silver halide grains of which is described in U.S. Pat. Nos. 3,206,316, 3,317,322 and 3,367,778; an emulsion having silver halide grains incorporated with a polyvalent metal ion, of which is described in U.S. Pat. Nos. 3,271,157 and 3,447,927; a silver halide emulsion slightly chemical-sensitized on the surfaces of silver halide grains containing a doping agent, of which is described in U.S. Pat. No.

3,761,276; a silver halide emulsion comprising grains having a laminated layer structure, of which is described in JP OPI Publication Nos. 50-8524/1975, 50-38525/1975 and 53-2408/1978; and, besides, a silver halide emulsion described in JP OPI Publication Nos. 52-156614/1977 and 55-127549/1980.

An internal latent image type silver halide grain preferably applicable to the invention may be formed of a silver halide having any halogen compositions including, for example, silver bromide, silver chloride, silver chlorobromide, silver chloroiodide, silver iodobromide and silver chloroiodobromide. A grain containing silver chloride is excellent in development processability and suitable for a rapid processing photographic-processing.

The shapes of a silver halide grain applicable to the invention may be any one of a cube, an octahedron, a tetradecahedron consisting of a (100) plane and a (111) plane, a shape having a (110) plane, a spherical shape, a tabular-shape and so forth. The average grain-size thereof is preferably to be within the range of 0.05 to 3 μm. The grain-size distribution may be that of a monodisperse type emulsion having an uniformed crystal habit or that of an emulsion having an ununiformed grain-size or an ununiformed crystal habit. However, a monodisperse type silver halide emulsion having a uniformed grain-size and a uniformed crystal habit is preferred. In the invention, the expression, "a monodisperse type silver halide emulsion", herein means an emulsion in which the weight of a silver halide having a grain-size within the range of ±20% of an average grain-size rm is to be not less than 60%, preferably, not less than 70% and, more preferably, not less than 80% of the weight of the whole silver halide grain. The term, "an average grain-size rm", stated herein is defined as a grain-size $r_i$ obtained when maximizing a product $n_i \times r_i^3$ in which $n_i$ represents a frequency of a grain having a grain-size $r_i$, (provided that the significant figures are 3 columns and the fractions of 5 and over in the lowest column is counted as a unit and disregarded the rest). In the case of a spherical silver halide grain, the term, "a grain-size" herein stated means a diameter and, in the case of a grain having a shape other than the spherical shape, it means a diameter obtained by converting the projective image thereof into a circle having the same area as that of the grain. A grain-size can be measured in such a manner that a subject grain is magnified 10,000 to 50,000 times as large as the grain through an electron microscope and then photographed, and that the resulting diameter of the printed grain image or the area thereof projected is practically measured, (provided that the numbers of the grains subject to measurement are not less than 1,000 grains at random.)

A particularly preferable highly monodispersive emulsion is to have a distribution range (defined as follows) of not wider than 20%.

(Standard grain-size deviation/Average grain-size)× 100= Distribution range (%)

An average grain-size and a standard grain-size deviation are to be obtained from $r_i$ defined above.

A monodisperse type emulsion can be prepared in such a manner that a water-soluble silver salt solution and a water-soluble halide solution are added to a gelatin solution containing seed grains in a double-jet method under the control of the pAg and pH. When the adding rate is to be determined, The descriptions thereof in JP OPI Publication Nos. 54-48521/1979 and 58-49938/1983 may be referred.

As for the method of preparing a more higher monodisperse type emulsion, a method of growing an emulsion under the presence of a tetrazaindene compound may be used as described in JP OPI Publication No. 60-122935/1985.

A silver halide of the invention can be optically sensitized with a sensitizing dye having commonly been used. It is useful for a silver halide emulsion of the invention to make combination use of such a sensitizing dye applicable to a supersensitization as those used in an internal latent image type silver halide emulsion, a negative type silver halide emulsion and so forth. Such a sensitizing dye as mentioned above may be referred to Research Disclosure (hereinafter abbreviated to as RD) Nos. 15612 and 17643.

In the formation of an internal latent image type direct positive image preferably applicable to the invention, a fogging photographic-processing may be carried out by making an over-all exposure or by making use of a compound capable of producing a fogging nucleus, that is so-called a foggant.

An over-all exposure may be carried out in such a manner that an imagewise exposed light-sensitive material is dipped in or wetted with a developer or other aqueous solution and, is then uniformly exposed overall to light. A light source used therein may be any one, provided that it has rays of light having the same light-sensitive wavelength region as that of the light-sensitive material. Light having a high illumination intensity such as a flash-light may be applied for a short time, or weak light may also be applied for a long time. An overall exposure time is widely varied so that a best positive image can be obtained finally, according to the above-mentioned photographic light-sensitive materials, development conditions and light sources to be used. An exposure quantity of such an overall exposure as mentioned above is preferable to give an exposure quantity within a certain specific range in the combination thereof with a light-sensitive material. When applying an excessive exposure quantity, it usually tends to produce a minimum density increase and/or a desensitization, so that the resulting image quality may be deteriorated.

Now, a foggant preferably applicable to the invention will be detailed.

A foggant applicable to the invention include a wide variety of compounds. A foggant at issue may be made present when carrying out a development. For example, it may be contained in any component layer other than the support of a photographic light-sensitive material (inter alia, a silver halide emulsion layer is particularly preferable), or it ma also be contained in a developer, or in a processing solution to be used in prior to a development. An amount of a foggant to be used may be varied widely so as to meet the purpose of an application. When adding a foggant in a silver halide emulsion layer, it may be added in an amount within the range of, preferably, 1 to 1500 mg and, more preferably, 10 to 1000 mg per mol of silver halide used. When adding it to a processing solution such as a developer, it may be added in an amount within the range of, preferably, 0.01 to 5 g/liter and, more preferably, 0.05 to 1 g/liter.

A foggant applicable to the invention includes, for example, a hydrazine given in U.S. Pat. Nos. 2,563,785 and 2,588,982; A hydrazide or a hydrazine compound given in U.S. Pat. No. 3,227,552; A heterocyclic quaternary nitride compound given in U.S. Pat. Nos. 3,615,615, 3,718,479, 3,719,494, 3,734,738 and 3,759,901; and a compound such as an acyl hydrazinophenyl thiourea, that has an adsorptive group adsorbable to the surface of a silver halide, such as those given in U.S. Pat. No. 4,030,925. It is also allowed to make combination use thereof. For example, the foregoing RD 15162 describes that a non-adsorptive type foggant and an adsorptive type foggant may be used in combination. Such a combination technique is also effective in the invention. As for the foggants applicable to the invention, either one of the adsorptive type or the non-adsorptive type may be used independently or in combination.

Some typical examples of the useful foggants will be given as follows; namely, a hydrazine compound such as a hydrazine hydrochloride, 4-methyl phenyl hydrazine hydrochloride, 1-acetyl-2-phenyl hydrazine, 1-formyl-2-(4-methyl phenyl)hydrazine, 1-methyl sulfonyl-2-phenyl hydrazine, 1-methyl sulfonyl-2-(3-phenyl sulfonamido phenyl)hydrazine, 1-benzoyl-2-phenyl hydrazine and formaldehyde phenyl hydrazine; an N-substituted quaternary cycloammonium salt such as 3-(2-formyl ethyl)-2-methyl benzothiazolium bromide, 3-(2-acetyl ethyl)-2-benzyl-5-phenyl benzoxazolium bromide, 3-(2-acetyl ethyl)-2-benzyl benzoselenazolium bromide, 2-methyl-3-[3(phenyl hydrazino) propyl]benzothiazolium bromide, 1,2-dihydro-3-methyl-4-phenyl pyrido[2,1-b]benzothiazolium bromide, 1,2-dihydro-3-methyl-4-phenyl pyrido[2,1-b]benzoselenazolium bromide and 4,4'-ethylene bis(1,2-dihydro-3-methyl pyrido[2,1-b]benzo thiazolium bromide; 5-(3-ethyl-2-benzothiazolinylidene)-3-[4-(2 -formyl hydrazino)phenyl] rhodanine; 1,3-bis[4-(2-formyl hydrazino)phenyl]thiourea; 7-(3-ethoxythiocarbonyl amino benzamido)-9-methyl-10-propargyl-1,2,3,4-tetrahydro acridinium trifluoromethane sulfonate; and 1-formyl-2-[4-{3-(2-methoxyphenyl)ureido}phenyl]hydrazine.

With a photographic light-sensitive material having a silver halide emulsion layer relating to the invention, a direct positive image can be formed by making an imagewise exposure and then by making an overall exposure or by making a development in the presence of a foggant.

A developing agent applicable to a developer for developing a photographic light-sensitive material relating to the invention includes, for example, a polyhydroxy benzene such as hydroquinone, an aminophenol, a 3-pyrazolidone, an ascorbic acid and the derivatives thereof, a reductone, a phenylenediamine, or the mixtures thereof; and, to be more concrete, hydroquinone, aminophenol, N-methylaminophenol, 1-phenyl-3-pyrazolidone, 1-phenyl-4,4-dimethyl-3-pyrazolidone, 1-phenyl-4-methyl-4-hydroxymethyl-3-pyrazolidone, ascorbic acid, N,N-diethyl-p-phenylenediamine, diethylamino-o-toluidine, 4-amino-3-methyl-N-ethyl-N-(β-methanesulfonamido ethyl)aniline, 4-amino-3-methyl-N-(β-hydroxyethyl)aniline and 4-amino-N-ethyl-N-(β-hydroxyethyl)aniline. It is also allowed that a developing agent given above is contained in an emulsion in advance and is then reacted with a silver halide while it is dipped in an aqueous high-pH solution.

A developer applicable to the invention is further allowed to contain a specific antifoggant and a development inhibitor, or such a development additive as mentioned above may freely be incorporated into a component layer of a photographic light-sensitive material.

In a silver halide photographic light-sensitive material of the invention, a well-known photographic additive may be used.

The well-known photographic additives include, for example, the following compounds given in RD 17643 and RD 8716.

| | RD 17643 | | RD 18716 | |
|---|---|---|---|---|
| Additive | Page | Class | Page | Class |
| Chemical sensitizer | 23 | III | 648 | upper (R) |
| Sensitizing dye | 23 | IV | 648 | upper (R) |
| Development accelerator | 29 | XXI | 648 | upper (R) |
| Antifoggant | 24 | VI | 649 | lower (R) |
| Stabilizer | 24 | VI | 649 | lower (R) |
| Color-stain preventive | 25 | VII | 650 | (L)–(R) |
| Image stabilizer | 25 | VII | | |
| UV absorbent | 25–26 | VII | 649 (R)–650 (L) | |
| Filter dye | 25–26 | VII | 649 (R)–650 (L) | |
| Whitening agent | 24 | V | | |
| Hardener | 26 | X | 651 (R) | |
| Coating aid | 26–27 | XI | 650 (R) | |
| Surfactant | 26–27 | XI | 650 (R) | |
| Plasticizer | 27 | XII | 650 (R) | |
| Lubricant | 27 | XII | 650 (R) | |
| Antistatic agent | 27 | XII | 650 (R) | |
| Matting agent | 28 | XVI | 650 (R) | |
| Binder | 29 | IX | 651 (R) | |

In an emulsion layer of a light-sensitive material relating to the invention, a dye-forming coupler may be used so that a dye can be produced by carrying out a coupling reaction with an oxidant of a color developing agent. Such a dye-forming coupler as mentioned above is usually selected out so that a dye capable of absorbing a photosensitive spectrum from each of emulsion layers can be produced. A yellow dye-forming coupler is used in a blue-sensitive emulsion layer; a magenta dye-forming coupler, in a green-sensitive emulsion layer; and a cyan dye-forming coupler, in a red-sensitive emulsion layer, respectively. However, a silver halide color photographic light-sensitive material may also be prepared in any other method different from the above-mentioned combination so as to meet a purpose.

The above-mentioned dye-forming coupler is preferable to have a group having not less than 8 carbon atoms in the molecules thereof; such a group as mentioned above is capable of non-diffusing a coupler so-called a ballast group in the molecules thereof. The dye-forming coupler may be either 4-equivalent in which 4 molecules of silver ion are required to be reduced so as to form a molecule of a dye, or 2-equivalent in which 2 molecules of silver ion may be only reduced. It is also allowed to use a DIR coupler capable of releasing a development inhibitor according to the progress of a development so as to improve an image-sharpness and an image graininess, and a DIR compound capable of producing a colorless compound upon making a coupling reaction with an oxidant of a developing agent and, at the same time, releasing a development inhibitor.

The above-mentioned DIR couplers and DIR compounds each applicable thereto include, for example, those to which an inhibitor is directly coupled to a coupling position, and those to which an inhibitor is coupled to a coupling position through a divalent group so as to release the inhibitor upon making a intramolecular nucleophilic reaction or an intramolecular electron-transfer reaction produced inside a group split off upon making the coupling reaction (that is called a timing DIR coupler and a timing DIR compound).

It is allowed to make combination use of a colorless coupler capable of making a coupling reaction with an oxidant of an aromatic primary amine type developing agent, but incapable of producing any dye (that is also referred to as a competing coupler), and a dye-forming coupler.

As for a yellow dye-forming coupler, well-known acyl acetanilido type couplers are preferably used. Among them, a benzoyl acetanilido type compound and a pivaloyl acetanilido type compound are advantageous.

As for a magenta coupler, a 5-pyrazolone type coupler, a pyrazolobenzimidazole type coupler, a pyrazoloazole type coupler, an acyl acetonitrile type coupler and an indazolone type coupler each having been well-known may be used for.

As for a cyan dye-forming coupler, those of the phenol type, the naphthol type, or the imidazole type may be used for. For example, they are typified by a phenol type coupler in which an alkyl group, an acylamino group or a ureido group is substituted, a naphthol type coupler produced of a 5-aminonaphthol skeleton, and a 2-equivalent naphthol type coupler into which an oxygen atom is introduced as a splitting-off group.

For making a color tone resemblance to the color tone of a printing ink, it is preferable to use a magenta coupler and a yellow coupler in combination in a magenta image-forming layer of a color photographic light-sensitive material of the invention.

EXAMPLES

Now, the invention will be detailed with reference to the following examples. However, this invention shall not be limited thereto.

Example 1

Preparation of Emulsion EM-1

While controlling an aqueous solution containing ossein gelatin to be at 40° C., an aqueous solution containing ammonia and silver nitrate and an aqueous solution containing potassium bromide and sodium chloride (in a mol ratio of KBr:NaCl=95:5) were added thereto at the same time in a controlled double-jet method, so that a cubic-shaped silver chlorobromide core emulsion having a grain-size of 0.30 μm could be prepared. At that time, the pH and pAg were controlled so that the grains could be in the cubic form. To the resulting core emulsion, an aqueous solution containing ammonia and silver nitrate and an aqueous solution containing potassium bromide and sodium chloride (in a mol ratio of KBr:NaCl=40:60) were added thereto at the same time in a controlled double-jet method, so that shells could be so formed as to have an average grain-size of 0.42 μm. At that time, the pH and pAg were controlled so that the grains could be in the cubic form.

After the resulting emulsion was washed with water and the water-soluble salts were removed therefrom, gelatin was added, so that emulsion EM-1 could be prepared. The distribution range of the resulting emulsion EM-1 was proved to be 8%.

Preparation of Emulsion EM-2

While controlling an aqueous solution containing ossein gelatin to be at 40° C., an aqueous solution containing ammonia and silver nitrate and an aqueous solution containing potassium bromide and sodium chloride (in a mol ratio of KBr:NaCl=95:5) were added thereto at the same time in a controlled double-jet method, so that a cubic-shaped silver chlorobromide core emulsion having a grain-size of 0.18 μm could be prepared. At that time, the pH and pAg were controlled so that the grains could be in the cubic form. To the resulting core emulsion, an aqueous solution containing ammonia and silver nitrate and an aqueous solution containing potassium bromide and sodium chloride (in a mol ratio of KBr:NaCl=40:60) were added thereto at the same time in a controlled double-jet method, so that shells could be so formed as to have an average grain-size of 0.25 μm. At that time, the pH and pAg were controlled so that the grains could be in the cubic form.

After the resulting emulsion was washed with water and the water-soluble salts were removed therefrom, gelatin was added, so that emulsion EM-2 could be prepared. The distribution range of the resulting emulsion EM-2 was proved to be 8%.

Preparation of Blue-Sensitive Emulsion EM-B

Sensitizing dye D-1 was added to EM-1 so as to apply a color-sensitization to EM-1 and, thereafter, T-1 was added in an amount of 600 mg per mol of silver, so that blue-sensitive emulsion EM-B could be prepared.

Preparation of Green-Sensitive Emulsion EM-G

Green-sensitive emulsion EM-G was prepared in the same manner as in the blue-sensitive emulsion, except that sensitizing dye D-2 was added to EM-2 so as to apply a color-sensitization thereto.

Preparation of Red-Sensitive Emulsion EM-R

Red-sensitive emulsion EM-R was prepared in the same manner as in the blue-sensitive emulsion, except that sensitizing dyes D-3 and D-4 were added to EM-2 so as to apply a color-sensitization thereto.

Preparation of Panchromatic Emulsion EM-P

Panchromatically-sensitive emulsion EM-P was prepared in the same manner as in the blue-sensitive emulsion, except that sensitizing dyes D-1, D-2, D-3 and D-4 were added to EM-1 so as to apply a color-sensitization thereto.

T-1: 4-hydroxy-6-methyl-1,3,3a,7-tetrazaindene

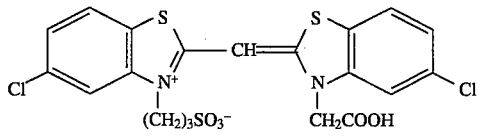

D-1

-continued

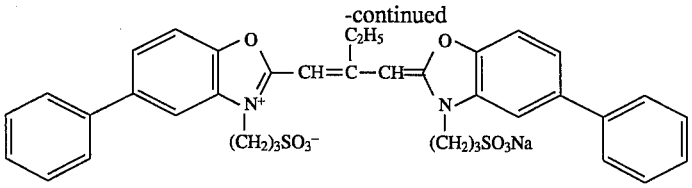

D-2

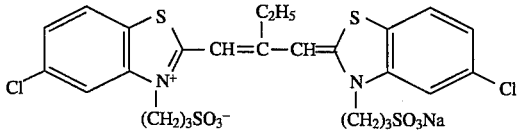

D-3

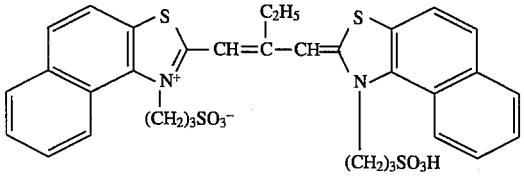

D-4

On a 110 μm-thick paper-made support laminated with polyethylene on one side thereof and polyethylene containing titanium oxide on the other side thereof, each of layers 1 through 10 having the following compositions was coated on the front side thereof (that was laminated only with polyethylene) by making use of the above-mentioned EM-B, EM-G, EM-R and EM-P, and layer 11 was coated on the rear side thereof, so that multilayered color light-sensitive material 1-1 could be prepared. Also, therein, SA-1 and SA-2 were each used as a coating aid and H-1 and H-2 were each used as a layer hardener.

SA-1: Sodium di(2-ethylhexyl) sulfosuccinate,

SA-2: Sodium di(2,2,3,3,4,4,5,5-octafluoropentyl) sulfosuccinate,

H-1: Sodium 2,4-dichloro-6-hydroxy-s-triazine, and

H-2: Tetrakis(vinyl sulfonylmethyl)methane.

| Layer | Composition | Coating weight ($g/m^2$) |
|---|---|---|
| Layer 10 | (a UV absorption layer) | |
| | Gelatin | 0.78 |
| | UV absorbent (UV-1) | 0.065 |
| | UV absorbent (UV-2) | 0.120 |
| | UV absorbent (UV-3) | 0.160 |
| | Solvent (SO-2) | 0.1 |
| | Silica matting agent | 0.03 |
| Layer 9 | (a blue-sensitive layer) | |
| | Gelatin | 1.43 |
| | Blue-sensitive emulsion EM-B (coating weight of silver) | 0.4 |
| | Panchromatically sensitive emulsion EM-P (coating weight of silver) | 0.1 |
| | Yellow coupler (YC-1) | 0.82 |
| | Antistaining agent (AS-2) | 0.025 |
| | Solvent (SO-1) | 0.82 |
| | Inhibitors | |
| | ST-1: | 0.0001 |
| | ST-2: | 0.0002 |
| | T-1 | 0.004 |
| Layer 8 | (an intermediate layer) | |
| | Gelatin | 0.54 |
| | Color-mixture preventive (AS-1) | 0.055 |

-continued

| Layer | Composition | Coating weight ($g/m^2$) |
|---|---|---|
| | Solvent (SO-2) | 0.072 |
| Layer 7 | (a yellow colloidal silver layer) | |
| | Gelatin | 0.42 |
| | Yellow colloidal silver | 0.1 |
| | Color-mixture preventive (AS-1) | 0.04 |
| | Solvent (SO-2) | 0.049 |
| | Polyvinyl pyrrolidone (PVP) | 0.047 |
| Layer 6 | (an intermediate layer) | |
| | Gelatin | 0.54 |
| | Color-mixture preventive (AS-1) | 0.055 |
| | Solvent (SO-2) | 0.072 |
| Layer 5 | (a green-sensitive layer) | |
| | Gelatin | 1.43 |
| | Green-sensitive emulsion EM-G (coating weight of silver) | 0.40 |
| | Panchromatically sensitive emulsion EM-P (coating weight of silver) | 0.10 |
| | Magenta coupler (MC-1) | 0.25 |
| | Yellow coupler (YC-2) | 0.06 |
| | Antistaining agent (AS-2) | 0.019 |
| | Solvent (SO-1) | 0.31 |
| | Inhibitors | |
| | ST-1: | 0.0001 |
| | ST-2: | 0.0002 |
| | T-1 | 0.004 |
| Layer 4 | (an intermediate layer) | |
| | Gelatin | 0.75 |
| | Color-mixture preventive (AS-1) | 0.055 |
| | Solvent (SO-2) | 0.072 |
| Layer 3 | (a red-sensitive layer) | |
| | Gelatin | 1.38 |
| | Red-sensitive emulsion EM-R (coating weight of silver) | 0.30 |
| | Panchromatically sensitive emulsion EM-P (coating weight of silver) | 0.06 |
| | Cyan coupler (CC-1) | 0.44 |
| | Solvent (SO-1) | 0.31 |
| | Antistaining agent (AS-2) | 0.015 |
| | Inhibitors | |
| | ST-1: | 0.0001 |

-continued

| Layer | Composition | Coating weight ($g/m^2$) |
|---|---|---|
| | ST-2: | 0.0002 |
| | T-1 | 0.004 |
| Layer 2 | (an intermediate layer) | |
| | Gelatin | 0.60 |
| | Colorant (of which will be detailed later) | |
| Layer 1 | (a white-pigment layer) | |
| | Gelatin | 1.5 |
| | Anatase type titanium dioxide (of which will be detailed later) | |
| Layer 11 | (a rear-surface layer) | |

-continued

| Layer | Composition | Coating weight ($g/m^2$) |
|---|---|---|
| | Gelatin | 6.0 |
| | Silica matting agent | 0.2 |

The silver amounts coated were obtained by converting them into the corresponding amounts of silver used.

SO-1: Trioctyl phosphate,

SO-2: Dioctyl phthalate,

AS-1: 2,5-di-t-octyl hydroquinone

AS-2: 2,5-di-t-butyl hydroquinone

ST-1: 1-(3-acetamidophenyl)-5-mercaptotetrazole, and

ST-2: N-benzyl adenine.

UV-1

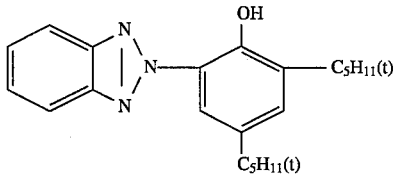

UV-2

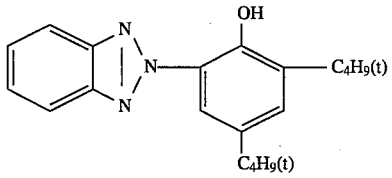

UV-3

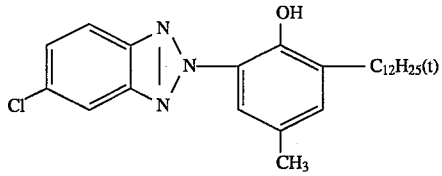

YC-1

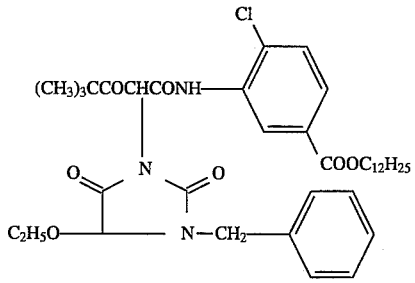

YC-2

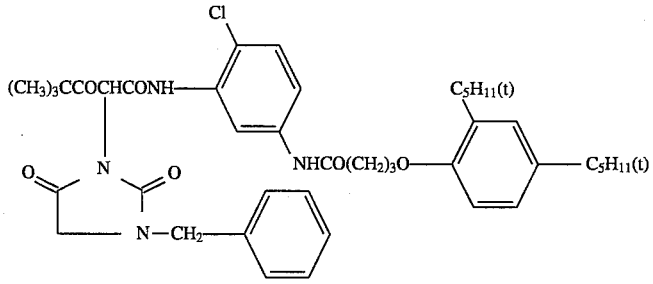

-continued

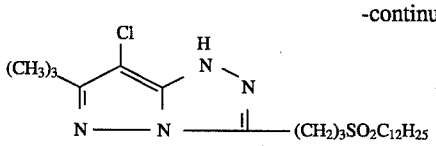

MC-1

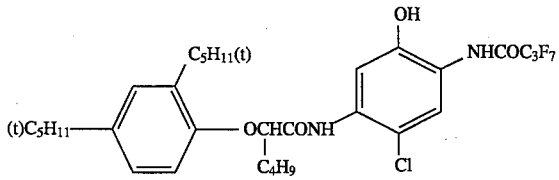

CC-1

Samples 1-2 through 1-10 were prepared by varying the amount of titanium oxide used in the above-mentioned layer 1 and the amount of the colorant used in layer 2 as shown below. (An oil-soluble dyes of the invention are represented by F-.)

| Sample No. | Titanium oxide | Colorant | Amount used (mg/m²) |
|---|---|---|---|
| 1-1 | Nil | Nil | (—) |
| 1-2 | Nil | F-4 | 0.1 |
| 1-3 | Nil | F-9 | 0.1 |
| 1-4 | Nil | Ultramarine blue | 0.1 |
| 1-5 | Nil | F-24 | 0.1 |
| 1-6 | 3.0 | Nil | |
| 1-7 | 3.0 | F-4 | 0.1 |
| 1-8 | 3.0 | F-9 | 0.1 |
| 1-9 | 3.0 | Ultramarine blue | 0.1 |
| 1-10 | 3.0 | F-24 | 0.1 |

Samples 1-1 through 1-10 were each brought into close contact with a black printer and a cyan printer out of the halftone-dot original document, and they were exposed to light under the following exposure conditions-1. Next, the black printer and the magenta printer were each brought into close contact therewith, and they were exposed to light under the following exposure conditions-2. Further, the black printer and the yellow printer were each brought into close contact therewith, and they were exposed to light under the following exposure conditions-3.

Each of the samples exposed to light in the above-mentioned manner was processed in the following development process, so that a dye image comprising halftone-dots could be obtained.

The results obtained from the density measurements will be shown below. In the density measurements, a densitometer, Model PD-65 manufactured by Konica Corp., was used.

Exposure Conditions-1

When exposing a light-sensitive material sample to white light through a red-filter (Wratten No. 26) and an ND filter, the exposure quantity was controlled by adjusting the density of the ND filter so that the halftone-dot portion of 50% of a cyan image can be reproduced to be 65% thereof after completing the development, and the exposure is then made for 0.5 seconds.

Exposure Conditions-2

When exposing a light-sensitive material sample to white light through a green-filter (Wratten No. 58) and an ND filter, the exposure quantity was controlled by adjusting the density of the ND filter so that the halftone-dot portion of 50% of a magenta image can be reproduced to be 65% thereof after completing the development, and the exposure is then made for 0.5 seconds.

Exposure Conditions-3

When exposing a light-sensitive material sample to white light through a blue-filter (Wratten No. 47B) and an ND filter, the exposure quantity was controlled by adjusting the density of the ND filter so that the halftone-dot portion of 50% of a yellow image can be reproduced to be 65% thereof after completing the development, and the exposure is then made for 0.5 seconds.

As for the light sources for exposure conditions-1 through -3, a daylight fluorescent lamp was used.

The processing photographic-processing were carried out in accordance with the following processing steps-1 (in a fresh-solution photographic-processing), provided that a fogging exposure was made uniformly overall the surface of the subject light-sensitive material, through a 3 mm-thick developer layer, as the subject light-sensitive material was dipped in the developer.

A part of another sample was exposed to light under quite the same conditions as in the case of the fresh-solution photographic-processing, and was then treated in the same manner as in processing step-1, except that the developer used in processing step-1 was further used in the running photographic-processing of the foregoing sample 1-4 until the total amount of the replenisher replenished to the developer could be 3 times as much as the capacity of the development tank, and the photographic-processing were carried out with the resulting developer, bleach-fixer and stabilizer, respectively, (that is called a running-solution photographic-processing).

In the image obtained by carrying out the fresh-solution photographic-processing, the neutral portions of the image consisting of 50% of the cyan, magenta and yellow images came out the excellently neutral gray images, respectively.

After the running-solution photographic-processing was carried out when the exposure was made under the conditions of a fresh-solution or the same conditions as those of making use of the fresh-solution, the visual judgments on the color tone of the image area formed of cyan, magenta and yellow halftone-dots each having a halftone-dot ratio of 20% and the color tone of the white background. Each of the evaluation thereof was graded by A (as excellent), B (as slightly inferior) or C (as inferior).

| Processing step-1 | Temperature | Time |
|---|---|---|
| Dipping (in a developer) | 37° C. | 12 sec. |
| Fogging exposure | — | 12 sec. (in lux) |
| Developing | 37° C. | 95 sec. |
| Bleach-fixing | 35° C. | 45 sec. |
| Stabilizing | 25–30° C. | 90 sec. |
| Drying | 60–85° C. | 40 sec. |

Each of the composition of the processing solutions was as follows.

| (Color developer) | |
|---|---|
| Benzyl alcohol | 15.0 ml |
| Ceric sulfate | 0.015 g |
| Ethylene glycol | 8.0 ml |
| Potassium sulfite | 2.5 g |
| Potassium bromide | 0.6 g |
| Sodium chloride | 0.2 g |
| Potassium carbonate | 25.0 g |
| T-1 | 0.1 g |
| Hydroxylamine sulfate | 5.0 g |
| Sodium diethylene triamine pentaacetate | 2.0 g |
| 4-amino-N-ethyl-N-(β-methane sulfonamidoethyl)metatoluidine 3/2 sulfate, monohydrate | 4.5 g |
| Fluorescent whitening agent, (4,4'-diaminostilbene disulfonic acid derivative) | 1.0 g |
| Potassium hydroxide | 2.0 g |
| Diethylene glycol | 15.0 ml |
| Add water to make in total | 1 liter |
| Adjust pH to be | 10.15 |
| **(Bleach-fixer)** | |
| Ferric ammonium diethylene triamine pentaacetate | 90.0 g |
| Diethylene triamine pentaacetic acid | 3.0 g |
| Ammonium thiosulfate, (in an aqueous 70% solution) | 180 ml |
| Ammonium sulfite, (in an aqueous 40% solution) | 27.5 ml |
| 3-mercapto-1,2,4-triazole | 0.15 g |
| Adjust pH with potassium carbonate or glacial acetic acid to be | 7.1 |
| Add water to make in total | 1 liter |
| **(Stabilizer)** | |
| o-phenyl phenol | 0.3 g |
| Potassium sulfite, (in an aqueous 50% solution) | 12 ml |
| Ethylene glycol | 10 g |
| 1-hydroxy ethylidene-1,1-diphosphonic acid | 2.5 g |
| Bismuth chloride | 0.2 g |
| Zinc sulfate, septihydrate | 0.7 g |
| Ammonium hydroxide, (in an aqueous 28% solution) | 2.0 g |
| Polyvinyl pyrrolidone (K-17) | 0.2 g |
| Fluorescent whitening agent, (4,4'-diaminostilbene disulfonic acid derivative) | 2.0 g |
| Add water to make in total | 1 liter |

-continued

| | |
|---|---|
| Adjust pH with ammonium hydroxide or sulfuric acid to be | 7.5 |

The stabilizing photographic-processing was carried out in a double-tank counter-current system.

The formula of the replenisher used in the running photographic-processing will be shown below.

| (Color development replenisher) | |
|---|---|
| Benzyl alcohol | 18.5 ml |
| Ceric sulfate | 0.015 g |
| Ethylene glycol | 10.0 ml |
| Potassium sulfite | 2.5 g |
| Potassium bromide | 0.3 g |
| Sodium chloride | 0.2 g |
| Potassium carbonate | 25.0 g |
| T-1 | 0.1 g |
| Hydroxylamine sulfate | 5.0 g |
| Sodium diethylenetriamine pentaacetate | 2.0 g |
| 4-amino-N-ethyl-N-(β-methanesulfon-amidoethyl)metatoluidine 3/2 sulfate, monohydrate | 5.4 g |
| Fluorescent whitening agent, (4,4'-diaminostilbene disulfonic acid derivative) | 1.0 g |
| Potassium hydroxide | 2.0 g |
| Diethylene glycol | 18.0 ml |
| Add water to make in total | 1 liter |
| Adjust pH to be | 10.35 |

Replenisher for Bleach-Fixer

The same as the above-mentioned bleach-fixer.

Replenisher for Stabilizer

The same as the above-mentioned stabilizer.

The amounts of the development replenisher, bleach-fixer and stabilizer replenished were each in an amount of 320 ml per $m^2$ of a light-sensitive material to be processed.

| | 50% portion | | 20% portion | | White background | |
|---|---|---|---|---|---|---|
| Sample No. | Fresh solution | Running solution | Fresh solution | Running solution | Fresh solution | Running solution |
| 1-1 | A | C | C | C | A | C |

-continued

| Sample No. | 50% portion | | 20% portion | | White background | |
|---|---|---|---|---|---|---|
| | Fresh solution | Running solution | Fresh solution | Running solution | Fresh solution | Running solution |
| 1-2 | A | (yellow) C | (Yellow) C | (yellow) C | C | (Yellow) C |
| 1-3 | A | (yellow) C | (Yellow) C | (yellow) C | (Blue) C | (gray) C |
| 1-4 | A | (yellow) C | (Yellow) C | (yellow) C | (Blue) C | (gray) C |
| 1-5 | A | (yellow) C | (Yellow) C | (yellow) C | (Blue) C | (gray) C |
| 1-6 | A | B (Slightly (yellowish) | A | C (Yellow) | A | C (yellow) |
| 1-7 | A | A | A | A | A | A |
| 1-8 | A | A | A | A | A | A |
| 1-9 | A | A | A | A | A | A |
| 1-10 | A | A | A | A | A | A |

The words parenthesized indicate each the conditions of the color tone shifted from the neutral color. For example, (Yellow) indicates a condition where the tone came out yellowish inferiorly.

As is obvious from the results shown above, the samples of the invention were proved that an image excellent in 20% highlight portion and white background could be obtained when each of the 50% halftone-dots in cyan, magenta and yellow was reproduced into the neutral. The samples other than those of the invention could not obtain any image satisfactory in the neutrality of highlight or in white background.

Example 2

Samples 2-1 through 2-4 were each prepared in the same manner as in Sample 1-6 prepared in Example 1, except that gelatin used was replaced by those having the following compositions. Further, Sample 2-5 was also prepared in the same manner as in Sample 2-4, except that the gelatin content of Layer 1 of Sample 2-4 was changed into an amount of 1.0 g/m$^2$. The total amounts of gelatin used and the gelatin contents of Layers i through 10 will be shown below.

| Sample No. | Gelatin used | Amount of gelatin added (in g/m$^2$) |
|---|---|---|
| 2-1 | Gelatin A | 9.37 |
| 2-2 | Gelatin B | 9.37 |
| 2-3 | Gelatin C | 9.37 |
| 2-4 | Gelatin D | 9.37 |
| 2-5 | Gelatin D | 8.87 |

Gelatin A: An alkali-treated gelatin prepared of a cattle bone (having an iron content of 8.2 ppm),
Gelatin B: Ion-exchange treated Gelatin A (having an iron content of 5.8 ppm),
Gelatin C: Ion-exchange treated Gelatin A (having an iron content of 4.1 ppm), and
Gelatin D: Gelatin A treated with a chelate resin (having an iron content of 2.5 ppm)

Each of the samples was exposed to light in accordance with Example 1 and was then processed under the processing conditions for the fresh solution described in Example 1. Another part of each sample was processed in the running solutions described in Example 1.

With the resulting images, the blue light density in the white background thereof was measured. The results thereof will be shown below.

| Sample No. | Blue light density in the white background | |
|---|---|---|
| | With fresh solution | With running solution |
| 2-1 | 0.18 | 0.23 |
| 2-2 | 0.18 | 0.22 |
| 2-3 | 0.12 | 0.14 |
| 2-4 | 0.11 | 0.12 |
| 2-5 | 0.10 | 0.11 |

As is obvious from the results shown above, the samples having a white-pigment layer was proved to be excellent when using gelatin having an iron content less than 5 ppm, and also proved that an excellent white background could be maintained even when the processing conditions such as a running photographic-processing should be changed. Further, Sample 2-5 containing gelatin in an amount of not more than 9 g/m$^2$ could be proved to realize a more excellent white background.

Example 3

Light-sensitive material Samples 3-1 and 3-2 were each prepared, respectively, in the same manner as in Samples 1-7 of Example 1 and 2-4 of Example 2, except that emulsion EM-B was replaced by a negative type blue-sensitive silver chlorobromide emulsion (in a ratio of AgBr:AgCl=70:30), EM-G was replaced by a negative type green-sensitive silver chlorobromide emulsion (in a ratio of AgBr:AgCl=70:30) and EM-R was replaced by a negative type red-sensitive silver chlorobromide emulsion (in a ratio of AgBr:AgCl=70:30), and that each of emulsions EM-P contained in layers 4, 6 and 10 was removed.

Samples 3-1 and 3-2 were each exposed to light through an optical wedge in an ordinary sensitometry and were then processed with fresh solutions under processing conditions described in Example 1. Another part of the samples was processed with running solutions in the processing conditions described in Example 1; provided that the processing photographic-processing mentioned above were carried out without making any overall exposure in the developer.

With the white background of the resulting image, the blue-light density was measured. The results were proved to be that the increase of the blue-light density was inhibited and that an excellent white background could be displayed.

Advantages of the Invention

When making use of a silver halide color photographic light-sensitive material of the invention, the reproduction of highlight and white background portions can be excellently provided by a halftone-dot image information, and a color image suitable for a stable color proof can be provided even in a running process.

What is claimed is:

1. A silver halide color photographic light-sensitive material comprising a reflective support composed of polyolefin resin-coated paper having provided on one side thereof photographic component layers comprising a hydrophilic colloidal layer containing a white pigment, a non-light-sensitive hydrophilic colloidal layer, and a silver halide emulsion layer, wherein at least one of said photographic component layers contains an oil-soluble dye or a colored pigment, neither of which substantially decolorizes upon photographic processing, an iron content of a gelatin contained in said photographic component layers being less than 5 ppm.

2. The material of claim 1, wherein a coating amount of a gelatin contained in said photographic component layers is not more than 9 $g/m^2$.

3. The material of claim 1, wherein said oil-soluble dye is a anthraquinone compound or an azo compound.

4. The material of claim 1, wherein the molecular extinction coefficient in the maximum absorption wave length of not shorter than 400 nm of said oil-soluble dye is not less than 5000.

5. The material of claim 1, wherein the molecular extinction coefficient in the maximum absorption wave length of not shorter than 400 nm of said oil-soluble dye is not less than 20000.

6. The material of claim 1, wherein said oil-soluble dye is represented by Formula 1 or Formula 2:

Formula 1

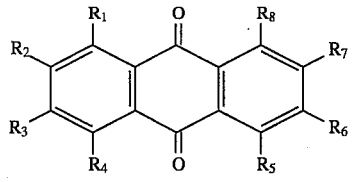

wherein $R^1$ through $R^8$ each represent a hydrogen atom, a hydroxyl group, an amino group or a halogen atom;

Formula 2

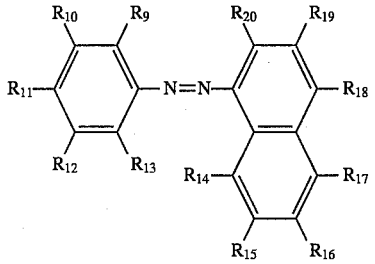

wherein $R^9$ through $R^{20}$ each represent a hydrogen atom, a halogen atom, a nitro group, a hydroxyl group, an alkyl group, an alkoxyl group, an aminocarbonyl group, amino group or an —N=N—R group, provided that R represents an aryl group.

7. The material of claim 1, wherein an iron content of a gelatin contained in said photographic component layers, is less than 3 ppm.

8. The material of claim 1, wherein a jelly strength of a gelatin contained in photographic component layers, is not less than 250 g.

9. The material of claim 1, wherein a calcium content of a gelatin contained in photographic component layers, is not more than 1000 ppm.

* * * * *